US011708713B2

(12) United States Patent
Colligan et al.

(10) Patent No.: US 11,708,713 B2
(45) Date of Patent: Jul. 25, 2023

(54) LIGATURE RESISTANT SWINGING DOOR SYSTEM

(71) Applicant: Accurate Lock & Hardware Co. LLC, Stamford, CT (US)

(72) Inventors: Francis Colligan, New Haven, CT (US); Daniel Barahona, Stamford, CT (US)

(73) Assignee: Accurate Lock & Hardware Co. LLC, Stamford, CT (US)

( * ) Notice: Subject to any disclaimer, the term of this patent is extended or adjusted under 35 U.S.C. 154(b) by 56 days.

(21) Appl. No.: 17/481,454

(22) Filed: Sep. 22, 2021

(65) Prior Publication Data

US 2022/0282565 A1 Sep. 8, 2022

Related U.S. Application Data

(60) Provisional application No. 63/156,584, filed on Mar. 4, 2021.

(51) Int. Cl.
*E05F 1/06* (2006.01)
*E05D 7/081* (2006.01)

(52) U.S. Cl.
CPC ..... *E05F 1/063* (2013.01); *E05D 7/081* (2013.01)

(58) Field of Classification Search
CPC ..... E05F 1/063; E05D 7/081
USPC ..... 49/236, 237
See application file for complete search history.

(56) References Cited

U.S. PATENT DOCUMENTS

| | | | | |
|---|---|---|---|---|
| 879,542 | A * | 2/1908 | Hartman | |
| 3,398,487 | A * | 8/1968 | Matyas | E06B 3/72 16/312 |
| 4,215,449 | A * | 8/1980 | Loikitz | |
| 5,265,311 | A * | 11/1993 | Gard | |
| 7,000,289 | B2 * | 2/2006 | Cedrone | |
| 7,024,823 | B2 | 4/2006 | Keller | |
| 8,584,494 | B2 | 11/2013 | Salvatore et al. | |
| 10,731,405 | B2 * | 8/2020 | Hall | E05D 11/06 |
| 11,193,325 | B2 * | 12/2021 | Clark | E06B 5/00 |
| 2004/0244293 | A1 * | 12/2004 | Eckel et al. | |
| 2005/0011046 | A1 * | 1/2005 | Dionysian | |

FOREIGN PATENT DOCUMENTS

| | | | | |
|---|---|---|---|---|
| EP | 1267027 | A2 * | 12/2002 | E05F 1/063 |

* cited by examiner

*Primary Examiner* — Daniel P Cahn
*Assistant Examiner* — Patrick B. Ponciano
(74) *Attorney, Agent, or Firm* — Forge IP, PLLC

(57) ABSTRACT

A swinging door assembly includes a frame mount, a door panel, and a pivot assembly operably connecting the door panel to the frame mount such that the door panel is pivotable in two opposite directions from a closed position to first and second opened positions. When the door panel is pivoted in the first direction by an angle less than a threshold angle, or is pivoted in the second direction by an angle less than the threshold angle, the door panel is biased toward the closed position by virtue of a weight of the door panel, and when the door panel is pivoted in the first direction by an angle greater than or equal to the threshold angle, or is pivoted in the second direction by an angle greater than or equal to the threshold angle, the door panel is no longer biased toward the closed position.

23 Claims, 8 Drawing Sheets

LIGATURE RESISTANT SWINGING DOOR SYSTEM

FIELD OF THE INVENTION

The present invention relates to door hardware, and more specifically to door hardware having ligature resistant characteristics, in that it is difficult for ropes, cords, wires, articles of clothing or other pieces of material (hereinafter referred to as "ligatures") to be anchored to the door hardware, whether intentionally or unintentionally, to cause harm to persons having access thereto. Even more particularly, the present invention relates to a swinging door system of the type often found on bathroom stalls and the like that possesses such ligature resistant characteristics.

BACKGROUND OF THE INVENTION

In many environments, such as, for example, although not limited thereto, medical facilities, prisons, schools, offices, government buildings, residences, and other institutions, there exists a population of people at risk of committing suicide. In many psychiatric hospitals, for example, patients have been known to attempt suicide, specifically hanging, while in the care of the institution.

These suicide attempts are known to have involved the use of doorknobs, hinges and other door hardware, particularly since an effort is often made to remove other ligature anchor points from the facilities. Institutions have many private rooms where such a suicide attempt may take place, such as bathrooms. Every private room cannot be watched at the same time without enormous staff resources. Therefore, private rooms, and specifically door hardware in these rooms, provide an area of opportunity for suicide attempts.

The problem of suicide attempts has been addressed in some institutions by simply removing all door hardware, and even the doors themselves. In some cases, door substitutes (such as, for example, curtains sewed with hook and loop fasteners) are employed instead of doors. While this may reduce the opportunity for suicide attempts, it likewise eliminates all privacy and security.

The Institute for Patient Centered Design (http://www.institutepcd.org/) identifies the four pillars of primary patient and family needs as: safety, patient empowerment and respect, connection to nature, and access to natural light. While a door may not have the same obvious impact as lighting and other design elements of a room, use of a door instead of a door substitute, or nothing at all, supports the concept of patient empowerment and respect, ultimately providing a safe opening solution that enhances the wellness journey.

Thus, what would be desirable instead would be door hardware that allows for a swinging door to operate in much the same way that traditional swinging doors operate (particularly, allowing for privacy and security), while at the same time obviating at least some of the traditional ligature anchor points.

SUMMARY OF THE INVENTION

Accordingly, it is an object of the present invention to provide a swinging door system of the type often found on bathroom stalls and the like that allows for the door to operate in much the same way that traditional swinging doors operate (particularly, allowing for privacy), while at the same time obviating the need altogether for at least some of the traditional ligature anchor points.

It is another object of the present invention to provide a swinging door system of this type which further allows the door to easily swing in both directions, but to be biased toward a closed position (at least in certain positions), without the need for springs or similar possible ligature points.

It is a further object of the present invention to provide such a swinging door system which is both aesthetically pleasing and which can be retrofit to existing doorways (such as existing patient bathroom doorways), to facilitate the updating of existing facilities.

These and other objectives are achieved, in accordance with a first aspect of the invention, by providing a swinging door assembly comprising a frame mount, a door panel, and a pivot assembly operably connecting the door panel to the frame mount such that the door panel is pivotable in a first direction from a closed position to a first opened position and is pivotable in a second direction, opposite to the first direction, from the closed position to a second opened position. When the door panel is pivoted in the first direction by an angle less than a threshold angle, or is pivoted in the second direction by an angle less than the threshold angle, the door panel is biased toward the closed position by virtue of a weight of the door panel, and when the door panel is pivoted in the first direction by an angle greater than or equal to the threshold angle, or is pivoted in the second direction by an angle greater than or equal to the threshold angle, the door panel is no longer biased toward the closed position.

In some embodiments, the first opened position is defined by the door panel being pivoted by about 90° in the first direction with respect to the closed position, and the second opened position is defined by the door panel being pivoted by about 90° in the second direction with respect to the closed position. In some embodiments, the threshold angle is about 60°.

In some embodiments, the pivot assembly comprises: a first pin disposed adjacent a top edge of the door panel and a second pin disposed adjacent a bottom edge of the door panel, the first and second pins allowing for the pivoting movement between the door panel and the frame mount, and a first biasing component associated with frame mount and a second biasing component associated with the door panel, each of the first and second biasing components comprising a flat portion and a beveled portion. When the door panel is pivoted in the first direction by an angle less than the threshold angle, or is pivoted in the second direction by an angle less than the threshold angle, the bias of the door panel toward the closed position is caused by the weight of the door causing the beveled portions of the first and second biasing components to slide with respect to each other, and when the door panel is pivoted in the first direction by an angle greater than or equal to the threshold angle, or is pivoted in the second direction by an angle greater than or equal to the threshold angle, the flat portions of the first and second biasing components engage one another such that the door panel is no longer biased toward the closed position due to cooperation of the beveled portions of the first and second biasing components.

In certain of these embodiments, the first and second biasing components are disposed adjacent to the bottom edge of the door panel. In certain embodiments, the beveled portions of the first and second biasing components are angled with respect to the flat portions of the first and second biasing components by about 45°. In certain embodiments, the first and second pins are axially slideable within sleeves in order to accommodate axial movement of the door panel with respect to the frame mount as the beveled portions of the first and second biasing components slide with respect to each other.

In some embodiments, a top edge of the door panel is defined by continuous curve along an entire length thereof. In certain of these embodiments, the curve of the top edge of the door panel has a varying radius of curvature that increases from and end adjacent to the frame mount to the end opposite to the frame mount.

In some embodiments, the frame mount is adapted to be affixed within a door opening. In some embodiments, the swinging door assembly further comprises a ligature resistant privacy element. In certain of these embodiments, the ligature resistant privacy element comprises a crescent pull and/or a ligature resistant thumb turn.

In accordance with another aspect of the present invention, a swinging door assembly comprises a frame mount, a door panel, and a pivot assembly operably connecting the door panel to the frame mount such that the door panel is pivotable in a first direction from a closed position to a first opened position and is pivotable in a second direction, opposite to the first direction, from the closed position to a second opened position. The pivot assembly comprises a first pin disposed adjacent a top edge of the door panel and a second pin disposed adjacent a bottom edge of the door panel, the first and second pins allowing for the pivoting movement between the door panel and the frame mount, and a first biasing component associated with frame mount and a second biasing component associated with the door panel, each of the first and second biasing components comprising a flat portion and a beveled portion. When the door panel is pivoted in the first direction by an angle less than a threshold angle, or is pivoted in the second direction by an angle less than the threshold angle, the weight of the door causes the beveled portions of the first and second biasing components to slide with respect to each other, thereby biasing the door panel toward the closed position. When the door panel is pivoted in the first direction by an angle greater than or equal to the threshold angle, or is pivoted in the second direction by an angle greater than or equal to the threshold angle, the flat portions of the first and second biasing components engage one another such that the door panel is no longer biased toward the closed position due to cooperation of the beveled portions of the first and second biasing components.

In some embodiments, the first opened position is defined by the door panel being pivoted by about 90° in the first direction with respect to the closed position, and the second opened position is defined by the door panel being pivoted by about 90° in the second direction with respect to the closed position. In some embodiments, the threshold angle is about 60°.

In some embodiments, the first and second biasing components are disposed adjacent to the bottom edge of the door panel. In some embodiments, the beveled portions of the first and second biasing components are angled with respect to the flat portions of the first and second biasing components by about 45°. In some embodiments, the first and second pins are axially slideable within sleeves in order to accommodate axial movement of the door panel with respect to the frame mount as the beveled portions of the first and second biasing components slide with respect to each other.

In some embodiments, a top edge of the door panel is defined by continuous curve along an entire length thereof. In certain of these embodiments, the curve of the top edge of the door panel has a varying radius of curvature that increases from and end adjacent to the frame mount to the end opposite to the frame mount.

In some embodiments, the frame mount is adapted to be affixed within a door opening. In some embodiments, the swinging door assembly further comprises a ligature resistant privacy element. In certain embodiments, the ligature resistant privacy element comprises a crescent pull and/or a ligature resistant thumb turn.

Other objects of the invention and its particular features and advantages will become more apparent from consideration of the following drawings and accompanying detailed description.

DETAILED DESCRIPTION OF THE INVENTION

Generally, the present invention provides a swinging door system of the type often found on bathroom stalls and the like that allows for the door to operate in much the same way that traditional swinging doors operate (particularly, allowing for privacy), while at the same time obviating the need altogether for at least some of the traditional ligature anchor points, that allows the door to easily swing in both directions, but to be biased toward a closed position (at least in certain positions), without the need for springs or similar possible ligature points and that is both aesthetically pleasing and that can be retrofit to existing doorways (such as existing patient bathroom doorways), to facilitate the updating of existing facilities Exemplary embodiments of the present invention will now be described with reference to the drawings.

Figure 1:
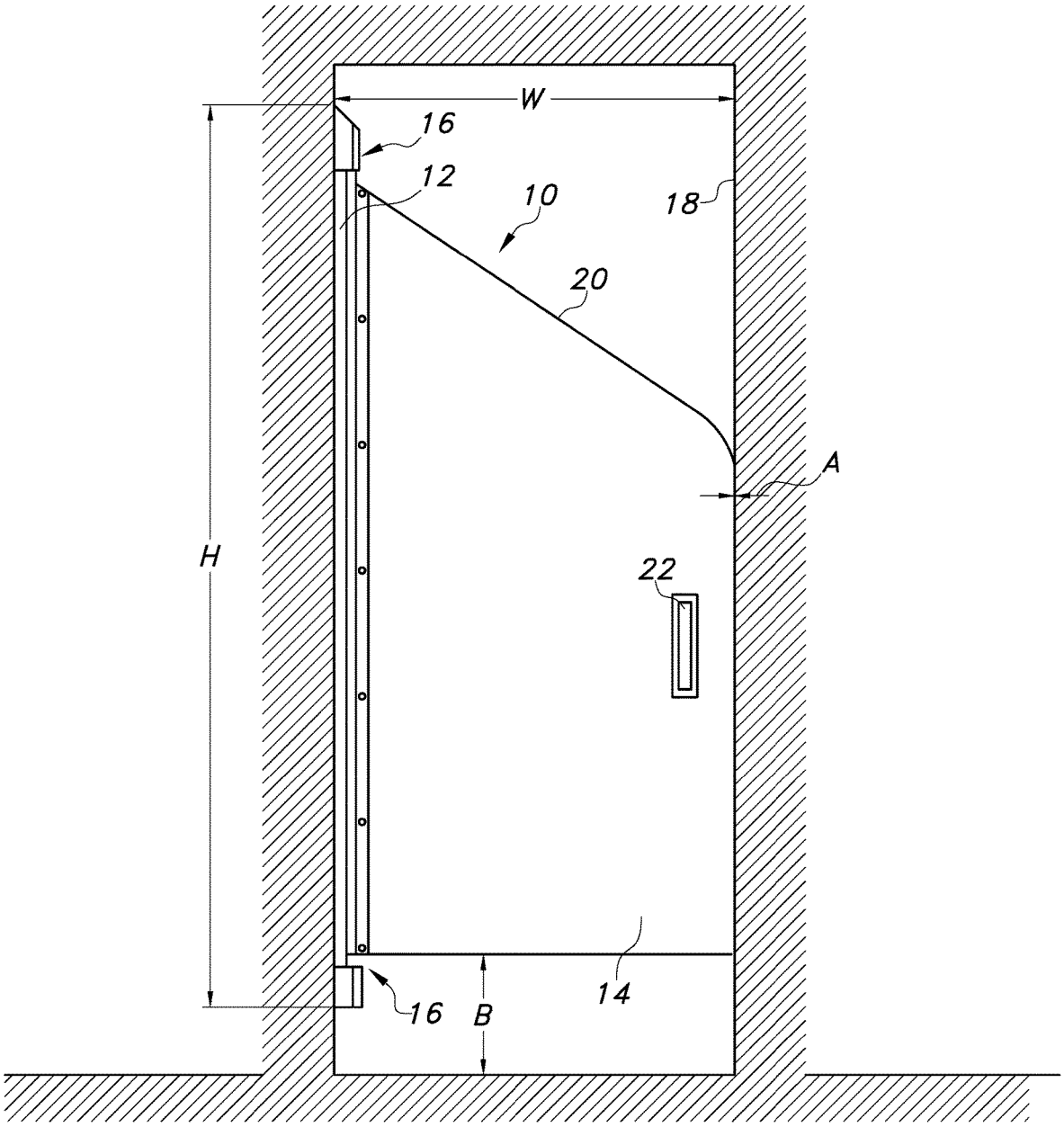
FIG. 1 is a side elevational view of an exemplary swinging door assembly in accordance with the present invention.

Referring first to FIG. 1, a swinging door assembly (10) includes a frame mount (12), a door panel (14), and a pivot assembly (16) (discussed in more detail below) operably connecting the door panel (14) to the frame mount (12) such that the door panel is pivotable in a first direction from a closed position to a first opened position and is pivotable in a second direction, opposite to the first direction, from the closed position to a second opened position.

The swinging door assembly (10) is disposed in a door opening (18), which may be of substantially any known type. For example, the door opening could take the form of an opening provided in a wall (with or without a door frame), the door opening could be formed by frame elements and/or panels (such as the case with bathroom stalls), etc. The frame mount (12) is rigidly affixed to one side of the door opening (18) by screws, bolts or the like, as is commonly known.

The door panel (14) and the door opening (18) are sized such that when in the door is in the closed position (shown in FIG. 1), the width of the door panel (14) substantially fills the width of the door opening (18) so as to provide privacy. However, preferably, a small gap, such as a ⅛ inch gap (A), may be provided so as to make it more difficult for ropes, cloths, etc. to be wedged between the door panel (14) and the door opening (18), thereby further reducing potential ligature anchor points. Although the swinging door assembly (10) of the present invention could be adapted to virtually any reasonably sized door opening, in the example shown, the width (W) of the door opening (18) is about 36 inches.

Similarly, the swinging door assembly (10) of the present invention could be used with door opening having any of various heights. Similar to the above with respect to the gap provided on the side of the door panel (14), it is preferable, though not required, for there to be provided gaps above and below the door panel (14), again to obviate potential ligature anchor points. On the other hand, of course, the gaps should not be so large that privacy is impeded. In the example shown, the height (H) of the overall swinging door assembly (10) is 72 inches, while the height (B) of the gap between the door panel (14) and the floor of the door opening (18) is 10 inches.

As can be seen, the gap between the top of the door panel (14) and the top of the door opening (18) is irregular in shape due to the fact that the top edge (20) of the door panel (14) is irregular in shape. As will be recognized, if the top edge (20) of the door panel (14) was horizontal, or included a portion that was horizontal, ligatures may be looped over the top of the door panel (14), thereby providing an undesirable ligature anchor point. Thus, the top edge (20) of the door panel is preferably inclined and/or curved, such that any ligature looped over the top of the door would slide down and off the door panel (14) if weight was applied thereto. While a straight top edge (20), with a sufficient incline with respect to horizontal, might provide adequate results depending on the situation, it has been found that configuring the top edge (20) of the door panel (14) as a continuous curve along an entire length thereof provides significantly improved results, both from anti-ligature and aesthetic standpoints. Most preferably, the curve of the top edge (20) of the door panel (14) has a varying radius of curvature that increases from an end adjacent to the frame mount (12) to the end opposite to the frame mount (12) (i.e., the end adjacent to the gap (A)).

The door panel (14) may be provided with any of various finishes to enhance the aesthetic appeal of the swinging door assembly (10). For example, the door system can be paired with various different door material options: e.g., black plastic, frosted polycarbonate, or aluminum, which can be finished as simulated wood or as required otherwise. Preferably, the material selected has a relatively low coefficient of friction, at least along the top edge (20) of the door panel (14) to further enhance the slipping of potential ligatures off the door panel (14) if weight is applied thereto.

If desired, the swinging door assembly (10) may optionally be provided with a ligature resistant privacy element (22), but otherwise preferably features no exposed hardware, aligning with modern interior design initiatives. For example, the ligature resistant privacy element (22) may take the form of a crescent pull and/or a ligature resistant thumb turn or the like (such as disclosed in U.S. Pat. No. 8,584,494, for example). Again, however, such is not necessary for operation of the swinging door assembly (10), as discussed more fully below.

Figure 2:
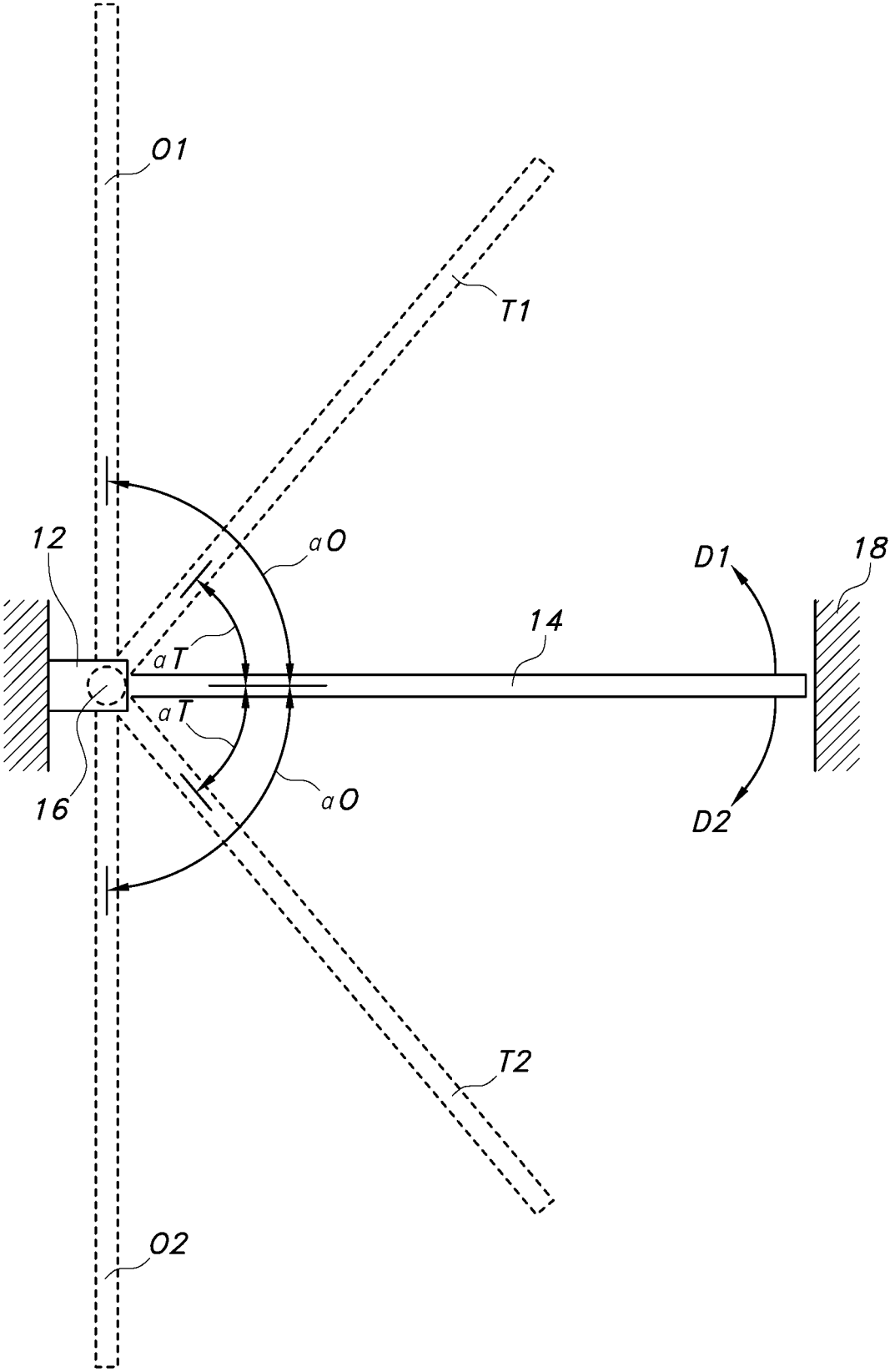
FIG. 2 is a top schematic view showing various operational positions of the swinging door assembly of FIG. 1.
Figure 4:
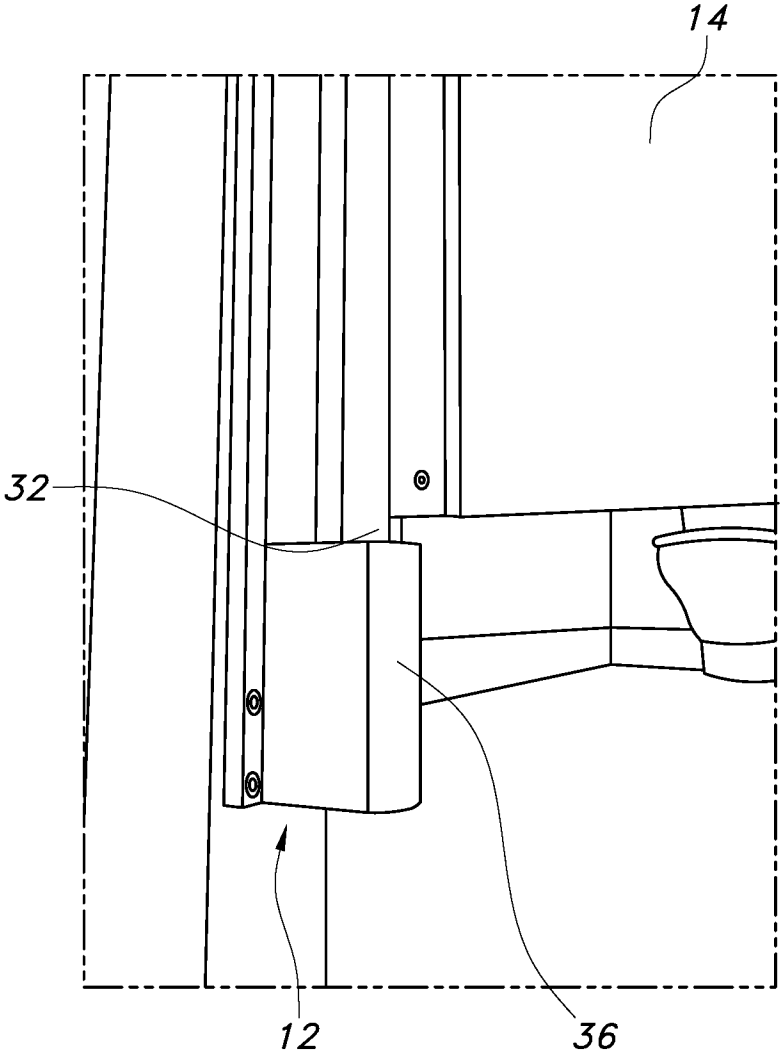
FIG. 4 is a side isometric view of a bottom end of the pivot assembly portion of the swinging door assembly of FIG. 1.
Figure 3:
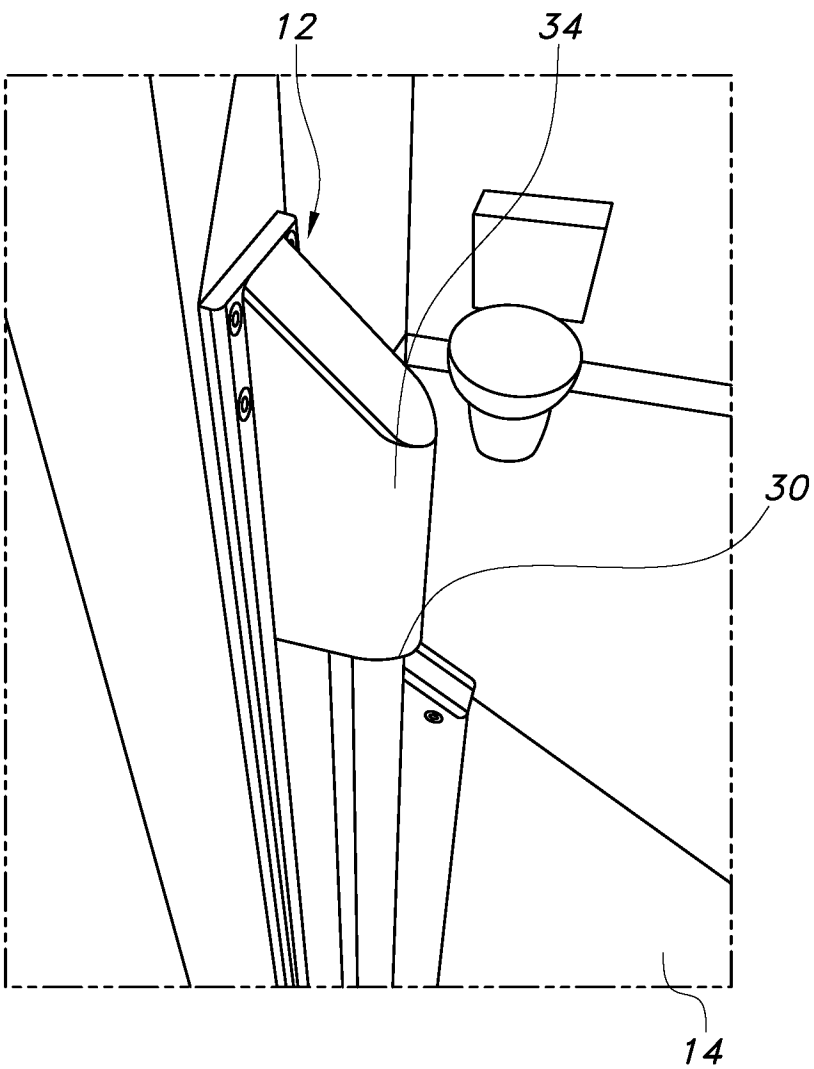
FIG. 3 is a side isometric view of a top end of the pivot assembly portion of the swinging door assembly of FIG. 1.

Turning now to FIG. 2, operation of the swinging door assembly (10) is now discussed. The closed position of door panel (14), which corresponds to the position also shown in FIG. 1, is illustrated by solid lines. As discussed above, however, the pivot assembly (16) operably connects the door panel (14) to the frame mount (12) such that the door panel (14) is pivotable in a first direction (indicated by arrow D1) from the closed position to a first opened position (O1) (illustrated by dashed lines) and is pivotable in a second direction (indicated by arrow D2), opposite to the first direction, from the closed position to a second opened position (O2) (illustrated by dashed lines).

When the door panel (14) is pivoted in the first direction (D1) by an angle less than a threshold angle ($\alpha T$), or is pivoted in the second direction (D2) by an angle less than the threshold angle ($\alpha T$), the door panel (14) is biased toward the closed position by virtue of a weight of the door panel (14), as more fully described below. On the other hand, when the door panel (14) is pivoted in the first direction (D1) by an angle greater than or equal to the threshold angle ($\alpha T$) such that it reaches a first threshold position (T1) (illustrated by dashed lines), or is pivoted in the second direction (D2) by an angle greater than or equal to the threshold angle ($\alpha T$) such that it reaches a second threshold position (T2) (illustrated by dashed lines), the door panel (14) is no longer biased toward the closed position, but instead will remain in its then current position absent some external force being applied thereto, also as more fully described below.

Preferably, though not necessarily, the first opened position (O1) is defined by the door panel (14) being pivoted in the first direction (D1) by an angle ($\alpha O$) of about 90° with respect to the closed position, and the second opened position (O2) is defined by the door panel (14) being pivoted in the second direction (D2) by an angle ($\alpha O$) of about 90° with respect to the closed position.

It has been found that excellent results are achieved when the threshold angle ($\alpha T$) is about 60°. However, this particular angle may be easily modified, if desired, as discussed below.

Turning now to FIGS. 3-8, the configuration of the pivot assembly (16) is discussed in more detail.

In general, the pivot assembly includes a first pin (30) disposed adjacent the top edge of the door panel (14) and a second pin (32) disposed adjacent a bottom edge of the door panel (14), the pins (30, 32) cooperating with corresponding sleeves (34, 36) provided as part of the frame mount (12). For this purpose, each of the sleeves is provided with a recess (38, 40) (best seen in FIG. 5) sized to receive the pins (30, 32) so that the pins (30, 32) may freely pivot therein without providing too much play.

Figure 6:
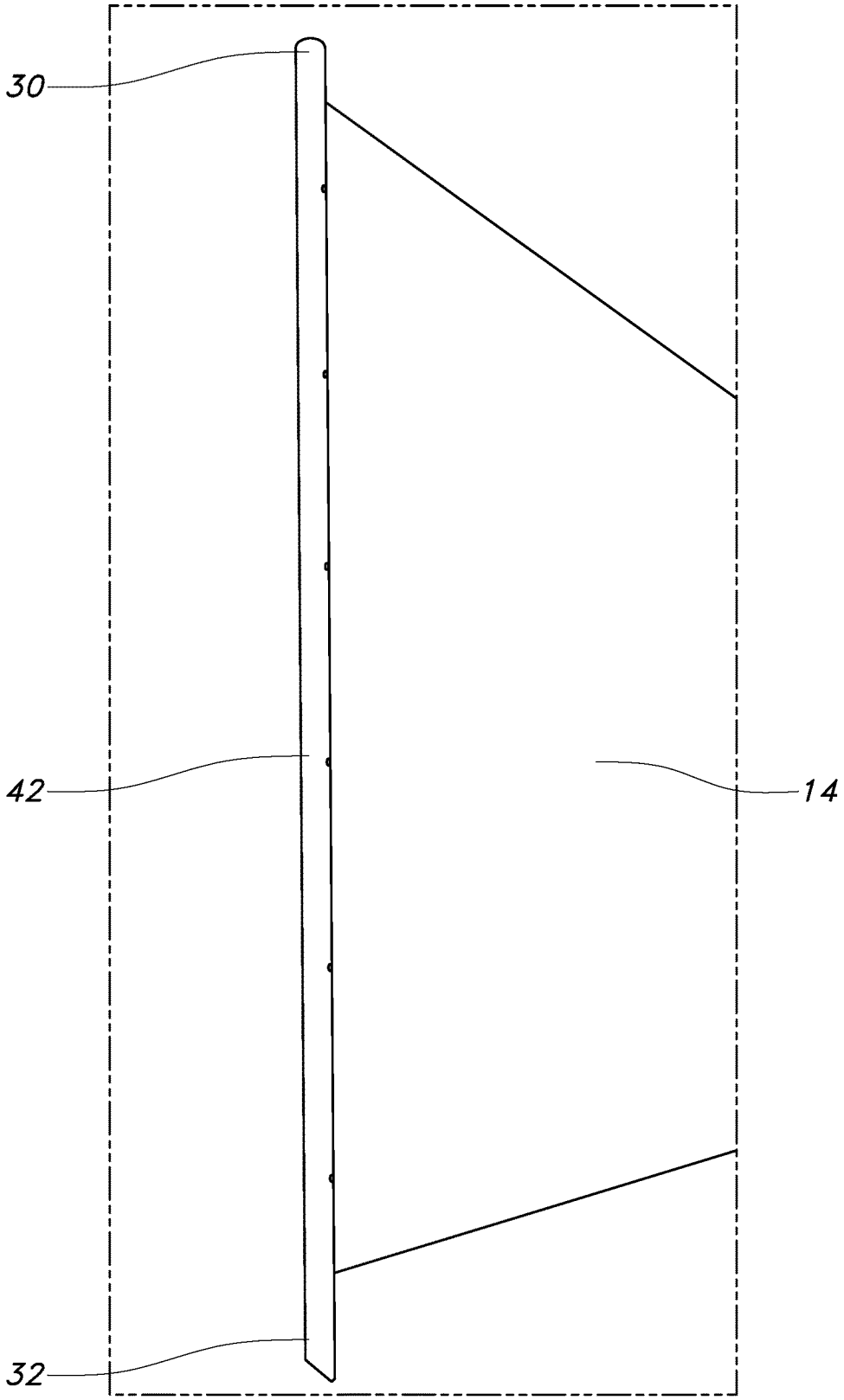
FIG. 6 is a side isometric view of a door panel side of the pivot assembly portion of the swinging door assembly of FIG. 1.

Although two pins (30, 32) are discussed, as best seen in FIGS. 1 and 6, the first and second pins (30, 32) may comprise portions of one continuous generally cylindrical rod (42), to which is attached the door panel (14), with the first and second pins (30, 32) defining the ends of the rod (42) extending beyond the top and bottom edges, respectively, of the door panel (14). However, other configurations are possible. For example, pins (30, 32) may comprise two separate elements that are individually affixed to the door panel (14) by way of fasteners, adhesives, welding, etc.

Figure 5:
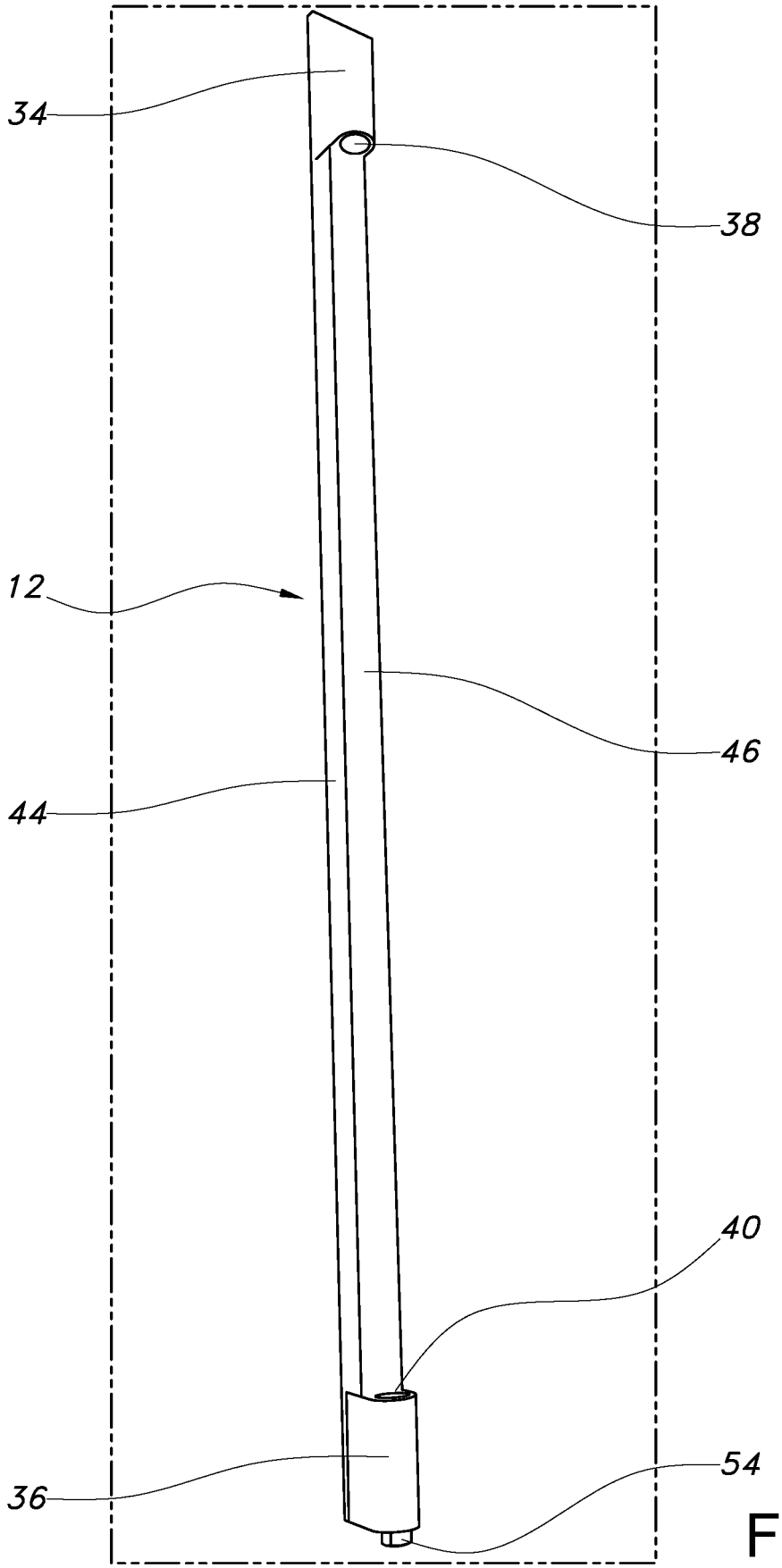
FIG. 5 is a side isometric view of a frame mount side of the pivot assembly portion of the swinging door assembly of FIG. 1.

As best seen in FIGS. 1 and 5, the frame mount (16) may be configured as one continuous piece extending along the entire height of the door panel (14), with the sleeves (34, 36) being attached to the top and bottom ends of a rail (44) in order to provide ease of assembly and retrofit. However, if desired, the sleeves (34, 36) themselves may be directedly mounted to the door opening (18) without the need for the rail (44). Most desirably, the rail (44) has formed therein a channel (46) extending along the length thereof, the channel (46) being sized and shaped to closely correspond to the size and shape of the rod (42), so as to inhibit ligatures from being slipped therebetween, thereby obviating another potential ligature anchor point.

Referring now specifically to FIGS. 7A-9B, the configuration and operation of the mechanism for selectively biasing the door panel (14) to the closed position will now be discussed.

The selective bias (the functional operation of which is discussed above in connection with FIG. 2) is achieved using two main elements: a first biasing component (50) associated with the frame mount (12) and a second biasing component (52) associated with the door panel (14).

Figure 7A:
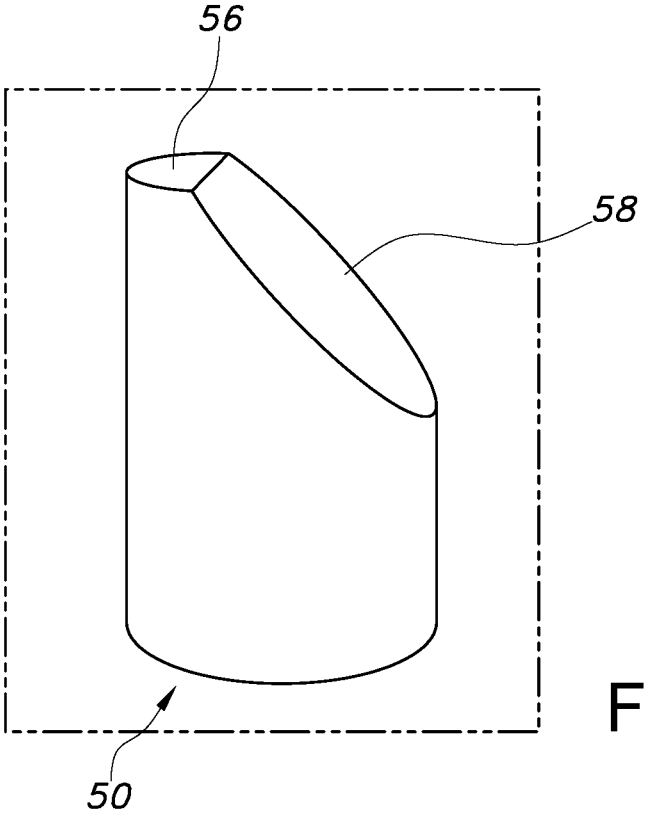
FIGS. 7A and 7B are, respectively, side isometric and side elevational views of a frame mount side biasing component of the pivot assembly portion of the swinging door assembly of FIG. 1.
Figure 7B:
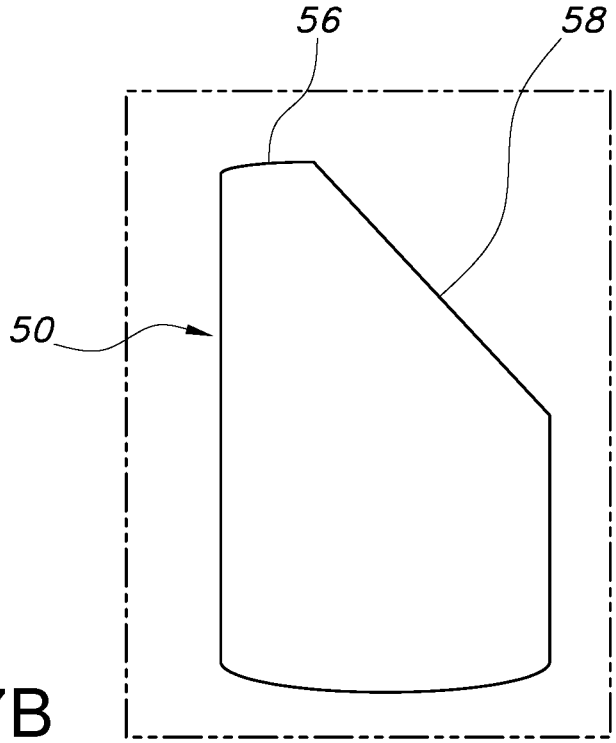

The first biasing component (50) associated with the frame mount (12), which is best seen in FIGS. 7A and 7B, is configured as an insert having a generally cylindrical cross section that is sized and shaped to be received within the recess (40) of the lower sleeve (36) of the frame mount (12). This first biasing component (50) may be inserted into the recess (40) during manufacture, and may include a threaded opening or the like (not shown) adapted to receive a screw, bolt or other fastener (54) (shown in FIG. 5) in order to secure the first biasing component (50) within the recess (40) and, importantly, to prevent it from rotating within the recess (40) during operation of the swinging door assembly (10).

As best seen in FIGS. 7A and 7B, the first biasing component (50) comprises a flat portion (56) and a beveled portion (58) angled with respect to the flat portion (56) at one end thereof. In the illustrated exemplary embodiment, the beveled portion (56) of the first biasing component (50) is inclined with respect to the flat portion (58) thereof by an angle of about 45°.

Figure 8:
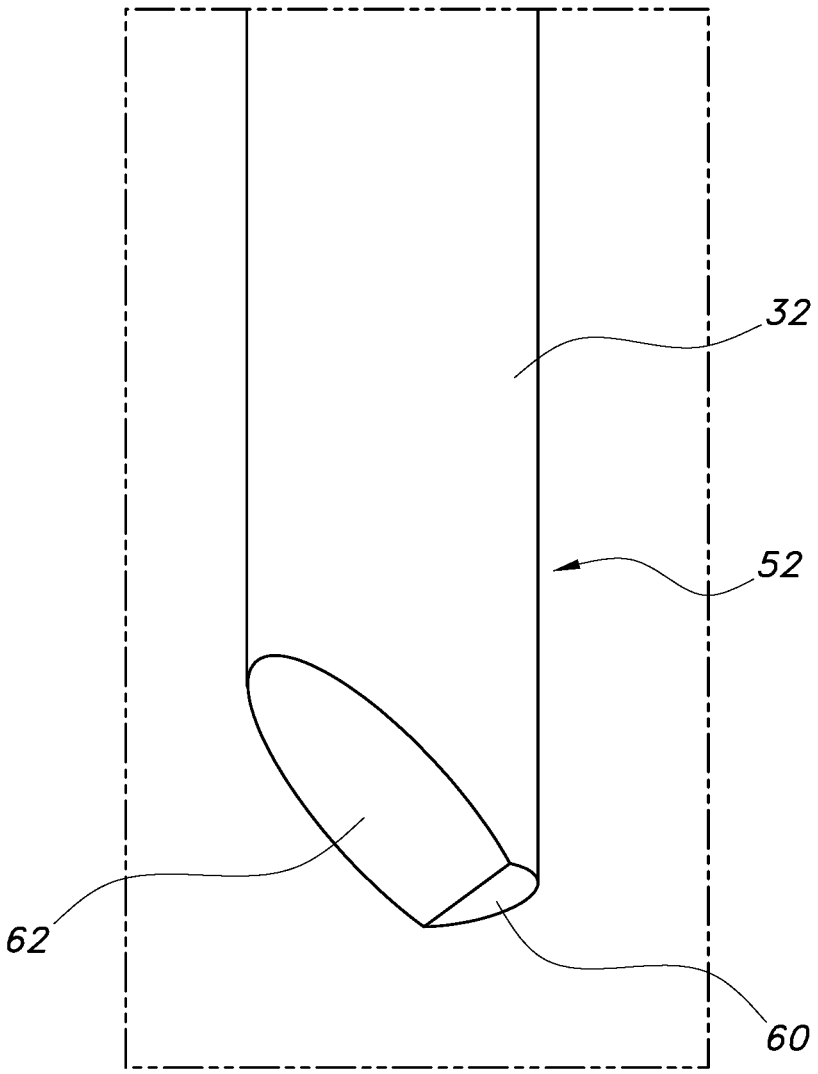
FIG. 8 is a side isometric view of a door panel side biasing component of the pivot assembly portion of the swinging door assembly of FIG. 1.

Referring now to FIG. 8, the second biasing component (52) is preferably integrally formed as part of the second pin (32) disposed adjacent a bottom edge of the door panel (14), although it will be recognized by those skilled in the art that the second biasing component (52) may instead be formed as a separate component that is attached to the second pin (32). In either event, the second biasing component (52) is configured in complimentary fashion with respect to the first biasing component (50). Specifically, the second biasing component (52) also has a generally cylindrical cross section that is sized and shaped to be received within the recess (40) of the lover sleeve (36) of the frame mount (12).

Like the first biasing component (50), the second biasing component (52) also comprises a flat portion (60) and a beveled portion (62) angled with respect to the flat portion (60) at one end thereof. In the illustrated exemplary embodiment, the beveled portion (62) of the second biasing component (52) is inclined with respect to the flat portion (60) thereof by an angle of about 45° in order to complement the configuration of the flat portion (56) and the beveled portion (58) of the first biasing component (50).

It should be noted, however, that the particular configuration illustrated—i.e., the angle between the flat portions (56, 60) and the beveled portions (58, 62) of the first and second biasing components (50, 52), as well as the illustrated size of the flat portions (56, 60) of the first and second biasing components (50, 52)—is what leads to the exemplary threshold angle ($\alpha T$) discussed above of about 60°. However, it should be recognized that by modifying the angle between the flat portions (56, 60) and the beveled portions (58, 62) of the first and second biasing components (50, 52), and/or by varying the illustrated size of the flat portions (56, 60) of the first and second biasing components (50, 52), the threshold angle ($\alpha T$) may also be modified.

Figure 9A:
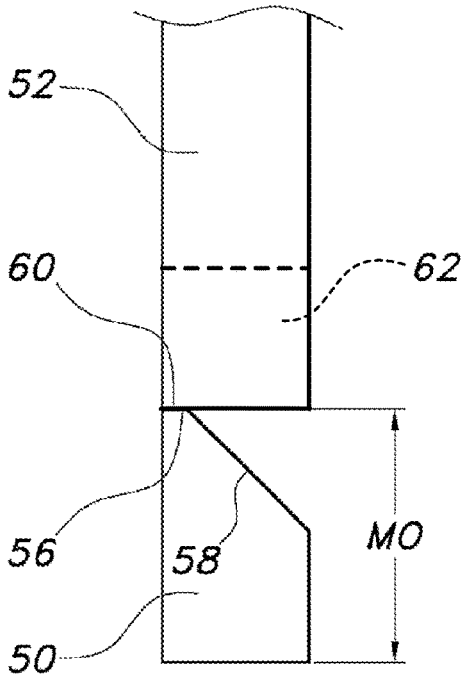
FIGS. 9A and 9B are side schematic views illustrating cooperation of between the frame mount side biasing component and the door panel side biasing component during operation of the swinging door assembly of FIG. 1.
Figure 9B:
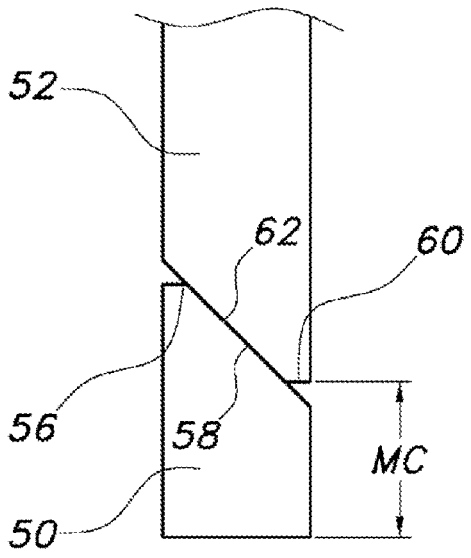

Turning now to FIGS. 9A and 9B, operation of the mechanism for selectively biasing the door panel (14), and in particular, the cooperation between the first and second biasing components (50, 52), will now be discussed.

When the door panel (14) is pivoted in the first direction by an angle less than the threshold angle ($\alpha T$), or is pivoted in the second direction by an angle less than the threshold angle ($\alpha T$), a bias is created on the door panel (14) toward the closed position (shown in FIG. 9B) due to the weight of the door causing the beveled portions (58, 62) of the first and second biasing components (50, 52), respectively, to slide with respect to each other, while at the same time pivoting the door panel (14) toward the closed position. Once in the fully closed position (shown in FIG. 9B), the beveled portions (58, 62) of the first and second biasing components (50, 52), respectively, are fully engaged with one another in that the entire faces of both beveled portions (58, 62) of the first and second biasing components (50, 52) are touching. This full engagement, coupled with the weight of the door, causes the door panel (14) to be urged to remain in this closed position.

On the other hand, when the door panel (14) is pivoted in the first direction by an angle greater than or equal to the threshold angle ($\alpha T$), or is pivoted in the second direction by an angle greater than or equal to the threshold angle ($\alpha T$), the flat portions (56, 60) of the first and second biasing components (50, 52), respectively, engage one another such that the door panel (14) is no longer biased toward the closed position due to cooperation of the beveled portions (58, 62) of the first and second biasing components (50, 52). Instead, once the threshold angle ($\alpha T$) is reached in either direction, and up until the fully open angle is reached in either direction ($\alpha O$), the flat portions (56, 60) of the first and second biasing components (50, 52), both being generally horizontal (i.e., perpendicular with respect to the force of gravity), merely slide with respect to one another.

The friction created between the flat portions (56, 60) of the first and second biasing components (50, 52) due to the weight of the door panel (14) will cause the door panel (14) to be urged to maintain its then current position between the threshold position (T1, T2) and the respective fully open position (O1, O2) in either direction. However, the amount of said friction being relatively small, the door panel (14) can be freely swung further open (if not already fully opened) or back toward the closed position, such that once the angle of the door panel (14) is less than the threshold angle ($\alpha T$) in either direction, the door panel (14) will again be biased toward the closed position.

As will be noted by comparing FIGS. 9A and 9B, the cooperation between the first and second biasing components (50, 52), and in particular the sliding of the beveled portions (58, 62) of the first and second biasing components (50, 52) with respect to each other, will cause the door panel (14), including the first and second pins (30, 32) to move vertically. More specifically, the door panel (14) moves between a lowest position (shown in FIG. 9B) when the door panel (14) is fully closed—wherein the flat portion of the second biasing component (52) is spaced a distance (MC) from a bottom of the first biasing component (52)—and a highest position (shown in FIG. 9A) when the door panel (14) is pivoted in either direction by an angle greater than or equal to the threshold angle (αT)—wherein the flat portion of the second biasing component (52) is spaced a distance (MO) from a bottom of the first biasing component (52). In the illustrated embodiment, the maximum vertical movement (i.e., the difference between MO and MC) is ⅝ of an inch. However, it will be recognized that this amount of maximum vertical movement may vary, for example, if the angle between the flat portions (56, 60) and the beveled portions (58, 62) of the first and second biasing components (50, 52), and/or the size of the flat portions (56, 60) of the first and second biasing components (50, 52), are varied.

In order to accommodate the above-described vertical movement of the door panel (14), including the first and second pins (30, 32), the first and second pins (30, 32) are axially slideable within sleeves (34, 36). In particular, the sleeves (34, 36) are dimensioned so as to provide sufficient room at the tops/bottoms of the recesses (38, 40) in order to accommodate the necessary amount of axial movement of the door panel (14) with respect to the frame mount (12) as the beveled portions (58, 62) of the first and second biasing components (50, 52) slide with respect to each other.

The present invention thus provides door hardware that allows for a swinging door to operate in much the same way that traditional swinging doors operate (particularly, allowing for privacy and security), while at the same time obviating at least some of the traditional ligature anchor points.

What is claimed is:

1. A swinging door assembly comprising:

a door panel;

a frame mount extending along an entire height of said door panel, said frame mount comprising a rail and sleeves disposed at top and bottom ends of said rail; and a pivot assembly operably connecting said door panel to said frame mount such that said door panel is pivotable in a first direction from a closed position to a first opened position and is pivotable in a second direction, opposite to the first direction, from the closed position to a second opened position, said pivot assembly comprising:

a first pin disposed adjacent a top edge of said door panel and a second pin disposed adjacent a bottom edge of said door panel, said first and second pins cooperating with said sleeves of said frame mount, thereby allowing for the pivoting movement between said door panel and said frame mount, wherein said first pin and said second pin comprise portions of one continuous generally cylindrical rod, to which is attached said door panel, with said first pin and said second pin defining ends of said rod extending beyond the top and bottom edges, respectively, of said door panel;

wherein said rail of said frame mount has formed therein a channel extending along a length thereof, said channel being sized and shaped to closely correspond to a size and shape of said rod, so as to inhibit ligatures from being slipped between said rod and said channel; and wherein when said door panel is pivoted in the first direction by an angle less than a threshold angle, or is pivoted in the second direction by an angle less than the threshold angle, said door panel is biased toward the closed position by virtue of a weight of said door panel, and wherein when said door panel is pivoted in the first direction by an angle greater than or equal to the threshold angle, or is pivoted in the second direction by an angle greater than or equal to the threshold angle, said door panel is no longer biased toward the closed position.

2. The swinging door assembly of claim 1 wherein the first opened position is defined by said door panel being pivoted by about 90° in the first direction with respect to the closed position, and wherein the second opened position is defined by said door panel being pivoted by about 90° in the second direction with respect to the closed position.

3. The swinging door assembly of claim 1 wherein the threshold angle is about 60°.

4. The swinging door assembly of claim 1 wherein said pivot assembly further comprises:

a first biasing component associated with frame mount and a second biasing component associated with said door panel, each of said first and second biasing components comprising a flat portion and a beveled portion;

wherein when said door panel is pivoted in the first direction by an angle less than the threshold angle, or is pivoted in the second direction by an angle less than the threshold angle, the bias of said door panel toward the closed position is caused by the weight of the door causing the beveled portions of said first and second biasing components to slide with respect to each other; and wherein when said door panel is pivoted in the first direction by an angle greater than or equal to the threshold angle, or is pivoted in the second direction by an angle greater than or equal to the threshold angle, the flat portions of said first and second biasing components engage one another such that said door panel is no longer biased toward the closed position due to cooperation of the beveled portions of said first and second biasing components.

5. The swinging door assembly of claim 4 wherein the first and second biasing components are disposed adjacent to the bottom edge of said door panel.

6. The swinging door assembly of claim 4 wherein the beveled portions of said first and second biasing components are angled with respect to the flat portions of said first and second biasing components by about 45°.

7. The swinging door assembly of claim 4 wherein the first and second pins are axially slideable within sleeves in order to accommodate axial movement of said door panel with respect to said frame mount as the beveled portions of said first and second biasing components slide with respect to each other.

8. The swinging door assembly of claim 4 wherein said first biasing component comprises an insert inserted into said sleeve disposed at the bottom end of said rail.

9. The swinging door assembly of claim 8 wherein said second biasing component is integrally formed as part of said second pin.

10. The swinging door assembly of claim 1 wherein said frame mount is adapted to be affixed within a door opening.

11. The swinging door assembly of claim 1 further comprising a ligature resistant privacy element.

12. The swinging door assembly of claim 11 wherein said ligature resistant privacy element comprises a crescent pull and/or a ligature resistant thumb turn.

13. A swinging door assembly comprising:

a door panel;

a frame mount extending along an entire height of said door panel, said frame mount comprising a rail and sleeves disposed at top and bottom ends of said rail; and a pivot assembly operably connecting said door panel to said frame mount such that said door panel is pivotable in a first direction from a closed position to a first opened position and is pivotable in a second direction, opposite to the first direction, from the closed position to a second opened position, said pivot assembly comprising:

a first pin disposed adjacent a top edge of said door panel and a second pin disposed adjacent a bottom edge of said door panel, said first and second pins cooperating with said sleeves of said frame mount, thereby allowing for the pivoting movement between said door panel and said frame mount, wherein said first pin and said second pin comprise portions of one continuous generally cylindrical rod, to which is attached said door panel, with said first pin and said second pin defining ends of said rod extending beyond the top and bottom edges, respectively, of said door panel;

wherein said rail of said frame mount has formed therein a channel extending along a length thereof, said channel being sized and shaped to closely correspond to a size and shape of said rod, so as to inhibit ligatures from being slipped between said rod and said channel; and a first biasing component associated with said frame mount and a second biasing component associated with said door panel, each of said first and second biasing components comprising a flat portion and a beveled portion;

wherein when said door panel is pivoted in the first direction by an angle less than a threshold angle, or is pivoted in the second direction by an angle less than the threshold angle, the weight of the door causes the beveled portions of said first and second biasing components to slide with respect to each other, thereby biasing said door panel toward the closed position; and wherein when said door panel is pivoted in the first direction by an angle greater than or equal to the threshold angle, or is pivoted in the second direction by an angle greater than or equal to the threshold angle, the flat portions of said first and second biasing components engage one another such that said door panel is no longer biased toward the closed position due to cooperation of the beveled portions of said first and second biasing components.

14. The swinging door assembly of claim 13 wherein the first opened position is defined by said door panel being pivoted by about 90° in the first direction with respect to the closed position, and wherein the second opened position is defined by said door panel being pivoted by about 90° in the second direction with respect to the closed position.

15. The swinging door assembly of claim 13 wherein the threshold angle is about 60°.

16. The swinging door assembly of claim 13 wherein the first and second biasing components are disposed adjacent to the bottom edge of said door panel.

17. The swinging door assembly of claim 13 wherein the beveled portions of said first and second biasing components are angled with respect to the flat portions of said first and second biasing components by about 45°.

18. The swinging door assembly of claim 13 wherein the first and second pins are axially slideable within sleeves in order to accommodate axial movement of said door panel with respect to said frame mount as the beveled portions of said first and second biasing components slide with respect to each other.

19. The swinging door assembly of claim 13 wherein said first biasing component comprises an insert inserted into said sleeve disposed at the bottom end of said rail.

20. The swinging door assembly of claim 19 wherein said second biasing component is integrally formed as part of said second pin.

21. The swinging door assembly of claim 13 wherein said frame mount is adapted to be affixed within a door opening.

22. The swinging door assembly of claim 13 further comprising a ligature resistant privacy element.

23. The swinging door assembly of claim 22 wherein said ligature resistant privacy element comprises a crescent pull and/or a ligature resistant thumb turn.

* * * * *